United States Patent [19]

Fritz et al.

[11] Patent Number: 4,473,029

[45] Date of Patent: Sep. 25, 1984

[54] ELECTROGRAPHIC MAGNETIC BRUSH DEVELOPMENT METHOD, APPARATUS AND SYSTEM

[75] Inventors: Garold F. Fritz, Webster; George P. Kasper, Rochester; Arthur S. Kroll, Rochester; Michael Mosehauer, Rochester, all of N.Y.

[73] Assignee: Eastman Kodak Company, Rochester, N.Y.

[21] Appl. No.: 510,109

[22] Filed: Jul. 1, 1983

[51] Int. Cl.[3] ..... G03G 15/09

[52] U.S. Cl. ..... 118/657; 430/122; 355/3 DD

[58] Field of Search ..... 118/657; 430/122; 355/3 DD

[56] References Cited

U.S. PATENT DOCUMENTS

| | | | |
|---|---|---|---|
| 3,152,924 | 10/1964 | Wanielista et al. | 118/637 |
| 4,235,194 | 11/1980 | Wada et al. | 118/657 |
| 4,334,497 | 6/1982 | Oka et al. | 118/698 |
| 4,345,014 | 8/1982 | Oka et al. | 430/122 |
| 4,435,494 | 3/1984 | Goto et al. | 430/122 |

FOREIGN PATENT DOCUMENTS 2029279A 3/1980 United Kingdom .

OTHER PUBLICATIONS

"Plain-Paper Copies Get Sharper Image with New Developer 'Pana Fine Process'"; reprint of article from the *National Technical Report*, vol. 28, No. 4, Aug. 1982.

*Primary Examiner*—John D. Welsh
*Attorney, Agent, or Firm*—John D. Husser

[57] ABSTRACT

Improved electrographic development is obtained in the presence of a development electrode field by predeterminedly rotating both the core and shell of a magnetic brush applicator to supply developer, of the kind comprising small particle, hard-magnetic carrier and electrically insulative toner, to an electrostatic imaging member which moves past a development station with predetermined linear velocity. In one preferred embodiment the core and shell are predeterminedly rotated so that the shell moves through the development zone at a rate preventing toner that is plated-out on the shell from affecting image development and so that the developer moves co-currently with the imaging member at a generally equal linear velocity.

55 Claims, 6 Drawing Figures

ELECTROGRAPHIC MAGNETIC BRUSH DEVELOPMENT METHOD, APPARATUS AND SYSTEM

BACKGROUND OF THE INVENTION

1. Field of the Invention

The present invention relates to improvements in electrographic development structures, procedures and systems (i.e. cooperative developer/applicator combinations) and more particularly to such improvements for development with electrographic developer containing hard magnetic carrier and electrically insulative toner.

2. Description of the Prior Art

U.S. application Ser. No. 440,146, filed Nov. 8, 1982, in the names of Miskinis and Jadwin, discloses a "Two-Component, Dry Electrographic Developer Compositions Containing Hard Magnetic Carrier and Method for Using the Same". In general, the system disclosed in that application employs, in combination with a magnetic brush applicator that comprises a magnetic core which rotates within a non-magnetic shell, a developer mixture that comprises electrically insulative toner particles and "hard" magnetic carrier particles (which exhibit a high minimum level of coercivity when magnetically saturated). The toner and carrier particles obtain an opposite triboelectric charge by mixing interactions. This applicator-developer system provides important electrographic development improvements, for example in increasing development rates, in reducing scratches in the developed image and in reducing developed image patterns that are caused by defects of the magnetic field pattern.

In continuing development work with applicator-developer systems such as described in the above-cited application, we have encountered several difficulties. For example, in some circumstances there occur unwanted density variations in background that are related to other solid-area image portions. Also, it has been noted that with some embodiments of the above-described system undesirable amounts of picked-up carrier particles are present in the developed image.

Further, we have discovered that there are some particularly preferred means and methods for implementing the development approach that is taught in the Miskinis and Jadwin application and that such preferred means and methods provide enhanced development results, e.g. from the combined viewpoints of (1) development completeness for solid area edges, fineline images and half-tone dots and (2) for uniformity and smoothness of image development.

SUMMARY OF THE INVENTION

Thus, one important purpose of the present invention is to provide improved means and methods for developing electrographic images, e.g., in systems of the kind disclosed in the Miskinis and Jadwin application.

More particularly, in one embodiment, the present invention provides an improved development system for electrographic apparatus of the type wherein an imaging member bearing an electrostatic pattern to be developed is moved at a predetermined linear velocity through a development zone where developer is to be applied. The improved development system comprises a supply of dry developer mixture, including electrically insulative toner particles and hard-magnetic carrier particles; a non-magnetic cylindrical shell which is rotatable for transporting developer between the supply and the development zone; a magnetic core that includes a plurality of magnetic pole portions located around its periphery in alternating magnetic polarity relation and is rotatable within the shell; and drive means for predeterminedly rotating the shell and the core. In one preferred embodiment the rotating means rotates the shell and the core in predetermined directions and at cooperatively predetermined rates such that the developer moves through the development zone co-currently with the image member and with a linear velocity generally equal to the linear velocity of the image member. In another preferred embodiment the shell is rotated at a rate which prevents toner plate-out thereon from adversely affecting image development. In another preferred embodiment the shell is rotated in a direction so that successive portions thereof pass through the development zone in a direction co-current with the direction of the image member movement and the core rotates in the opposite rotational direction from the shell so that the developer is transported through the development zone in a direction co-current with the image member direction, with developer transport components additively contributed by both shell and core rotations. In particularly preferred embodiments the foregoing aspects of the invention are employed cooperatively.

In other aspects the present invention provides apparatus and methods for implementing such development systems.

One significant advantage of the present invention is the substantial reduction of defects in developed images. The present invention also provides advantage from the viewpoints of development completeness and uniformity, or visual "smoothness", of the developed image. Another important advantage is that the present invention facilitates reductions in carrier pick-up on a developed imaging member. Preferred embodiments of the present invention provide electrographic image development methods, apparatus and systems which benefit cooperatively from all of the foregoing advantages.

BRIEF DESCRIPTION OF THE DRAWINGS

The subsequent detailed description of preferred embodiments of the invention refers to the attached drawings wherein.

DETAILED DESCRIPTION OF THE PREFERRED EMBODIMENTS

Figure 1:
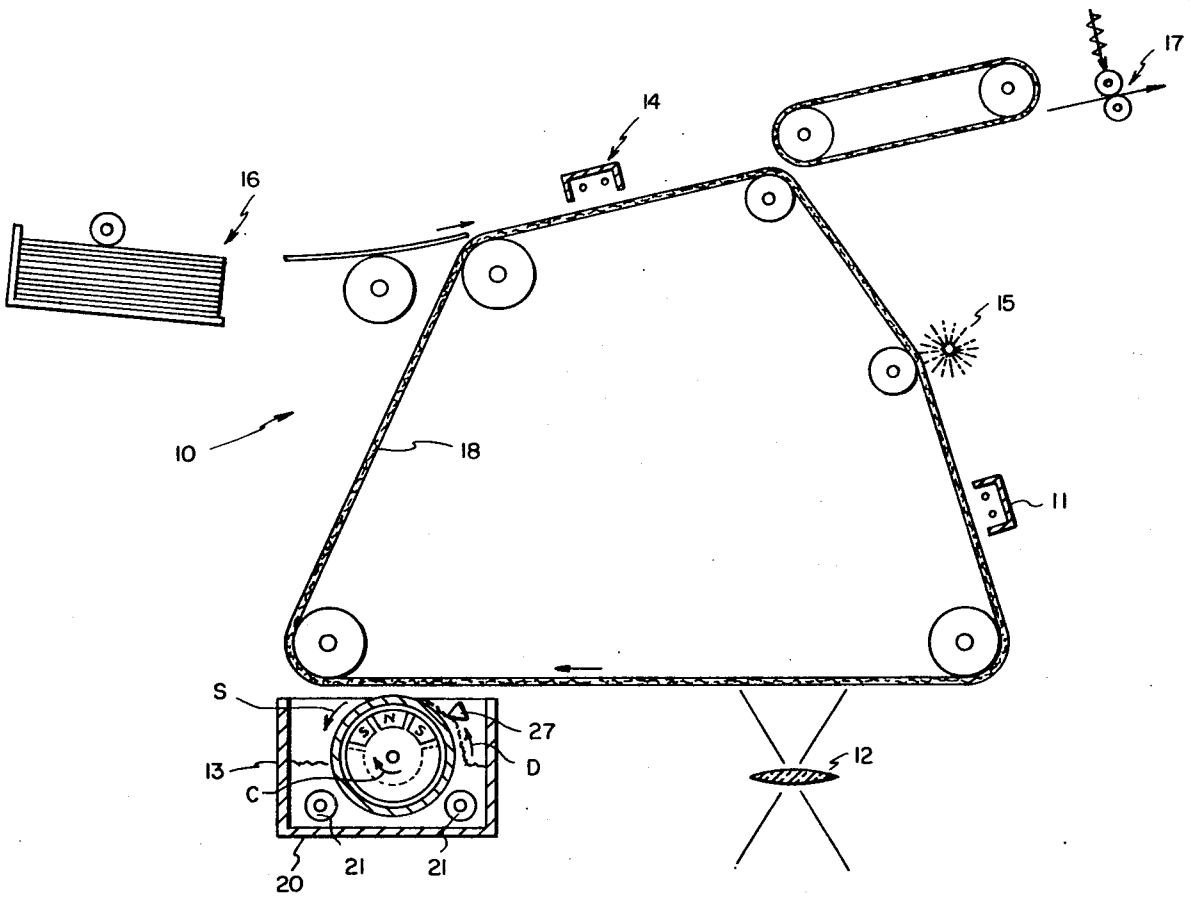
FIG. 1 is a schematic illustration of one electrographic apparatus for practice of the present invention.

FIG. 1 illustrates one exemplary electrographic apparatus 10 for practice of the present invention. In this embodiment, apparatus 10 comprises an endless electrophotographic image member 18 which is movable around an operative path past a primary charging station (represented by corona discharge device 11), an exposure station 12, a development station 13, a transfer station 14 and a cleaning station 15. In operation, device 11 applies a uniform electrostatic charge to a sector of the image member 18, which is then exposed to a light image at station 12 (to form a latent electrostatic image) and next developed with toner at station 13. The toner image is subsequently transferred to a copy sheet (fed from sheet supply 16) by transfer charger at station 14, and the toner-bearing copy sheet is fed through fusing rollers 17 to fix the transferred toner image. The image member sector is next cleaned at station 15 and is ready for reuse. With exception of the development station, the various stations and devices shown in FIG. 1 are conventional and can take various other forms.

Figure 3:
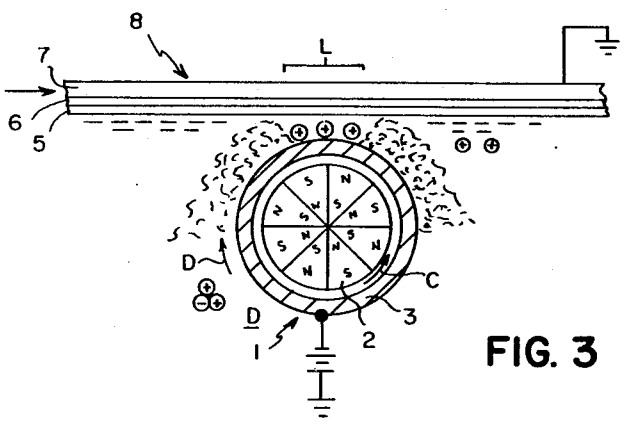
FIG. 3 is a schematic side view of an electrographic development system which is useful in explaining certain physical mechanism related to the present invention.

Before proceeding to the description of preferred embodiments of development systems, structures and modes in accord with the present invention, it will be helpful to explain briefly some physical phenomena which we have found to be involved in development systems of the kind comprising developers with hard magnetic carrier and applicators with a rotating magnetic core. Thus FIG. 3 illustrates schematically an exemplary development system wherein the developer D comprises a dry mixture of electrically insulative toner particles and hard magnetic carrier particles of the kind disclosed in the Miskinis and Jadwin application, and the applicator 1 includes a rotary magnetic core 2 which comprises a plurality of magnets with their pole portions (N, S) arranged alternately around the core periphery.

The core 2 rotates counterclockwise (arrow C) about a central axis and developer D, comprising positively charged, electrically insulative toner particles and negatively charged, hard-magnetic carrier particles, is transported clockwise around the stationary non-magnetic shell 3 of applicator 1 by the rotating magnetic fields presented by the moving magnetic core 2. The shell 3 is electrically conductive and biased to a negative potential that is chosen to prevent unwanted background development as explained below.

A photoconductor image member 8, including a photoconductive insulator layer 5 overlying a grounded conductive layer 6 on a support 7, is moved across a developing interface with the developer transported by applicator 1. On the photoconductor 8 there are negative electrostatic charges forming an image pattern to be developed by the attraction of positively charged toner particles, as well as some negative charge that should not be developed. (In FIG. 3, a double negative charge sign represents electrostatic image pattern to be developed and a single negative charge sign represents background charge that should not be developed.) In this simplified model, then, the electrical bias magnitude of shell 3 would be chosen as sufficiently negative to attract positive toner particles to an extent that prevents development of single-negative-charge portions but allow development of double-negative-charge portions.

From the foregoing it can be seen that, within the developer/photoconductor development interface (indicated as zone L in FIG. 3), there will be dynamic electric fields that: (1) urge positive toner particles toward the photoconductor where image (double negative) charge exists on the photoconductor and (2) attract positive toner particles away from the photoconductor where background (single negative) charge exists. The attraction of the positively charged toner toward the negatively biased shell is even stronger when no background charge is on the photoconductor (e.g. when a photoconductor portion with no negative charge passes).

After studying some perplexing defects in developed images, we hypothesized that the defects might be connected with such low (or zero) photoconductor charge conditions via the phenomenon which we term "toner plate-out" on the electrically biased shell. (In FIG. 3 such toner plate-out is represented by the positively charged toner on the shell 3, opposite a non-charge photoconductor portion.) We believe that in the usual course of development operations, such shell-attracted or "plated-out" toner is eventually attracted off of the shell by image charge portions on subsequently passing photoconductor regions. However, we now believe that at least one highly objectionable developed image defect can occur from such toner plate-out. The subsequent exemplary development sequence illustrates how we presently believe that defect is caused.

Figure 4C:
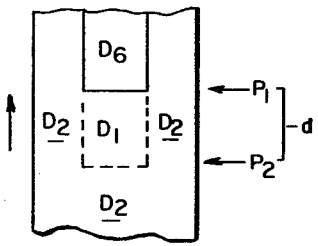
FIGS. 4A, 4B and 4C are schematic illustrations useful in the FIG. 3 explanation.

Consider first a development sequence involving a non-charged frame or a substantial area of low charge potential (white-exposed) region of the photoconductor. As shown in FIG. 4A and described above, the result is significant plate-out on portion Z (cross-hatched) of shell 3. Because the toner is electrically insulative (bearing a positive charge), we believe that the effect of significant toner plate-out on portions of the shell 3 is to reduce the effective bias level of such shell portions.

Figure 4B:
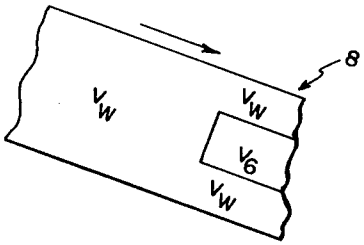
Figure 4A:
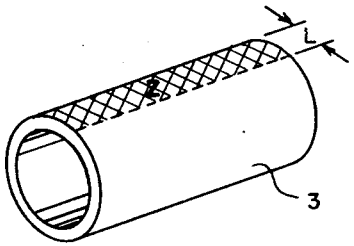

Consider next the subsequent movement through the development zone of a photoconductor portion 8 bearing a latent electrostatic image having a large solid area charge pattern $V_b$ (black image area) and laterally adjacent and following background charge $V_w$ portions (white image areas), see FIG. 4B. After its development by the applicator in the FIG. 4A condition, we found that the photoconductor portion which had the charge pattern shown in FIG. 4B exhibited the toner density levels shown in FIG. 4C, (density $D_6$ being a high density, density $D_2$ being a relatively low toner density and density $D_1$ being a zero or noticeably lower density level than density level $D_2$).

Based on our hypothesis outlined above, we conceived that the objectionable developed image defect of FIG. 4C (the noticeable $D_1$-$D_2$ toner density differential) occurs because the high charge area $V_b$ in FIG. 4B attracts plated-out toner from its opposing portions of shell 3, but the laterally adjacent low charge $V_w$ portions do not. The lower $D_1$ density portions would thus be caused by higher effective bias on de-plated shell portions and the density differential $D_1$-$D_2$ would exist until plate-out was again equalized across the width of the shell.

Based on this analysis, we conceived that a solution to the FIG. 4C image defects might be to rotate the shell with respect to the development zone L at a rate which avoided development-affecting plate-out. Considering a situation like that shown in FIG. 4C, we conceived that the shell rotation should desirably be such as to move a point on the shell periphery through the effective field at the development zone (generally the dimension L) before expiration of the time period when toner plate-out noticeably effects development. We determined this time period by first measuring the distance "d" between a commencement of plate-out on the developed photoconductor (position $P_1$ in FIG. 4C) and the position where the effect of plate-out becomes discernible on the photoconductor (position $P_2$ in FIG. 4C). Next we calculated the plate-out period $t_p$ (i.e. the time period for toner plate-out on the shell to reach an equilibrium condition) as being the time required for the photoconductor member to move the distance d (between $P_1$ and $P_2$)at its operative velocity $Vel._m$; that is, $t_p = d \div Vel._m$.

For example, when the photoconductor's operative velocity was 15 in/sec and the measured distance d was 3 inches, the plate-out period $t_p$ was 0.2 sec. For a typical development zone length L of about 0.25 inches, the shell velocity desirably would be at least about three (3) times higher than the 1.25 insec ($t_p \div L$), and preferably about an order of magnitude higher, i.e. about 12.5 in/sec or more. Upon testing this procedure of shell rotation, we found it to eliminate image defects such as described in FIG. 4C.

Generalizing, a mathematical expression can be derived for a desirable minimum linear shell velocity $Vel._s$ when a "d" value for the development system has been measured as described above. Thus:

$$t_p = d/Vel._m$$

where $t_p$ is the period for plate-out equilibrium to occur; $Vel._m$ is the linear velocity (in/sec) of the photoconductor member and d is the measured distance (in inches) $P_1$ to $P_2$, see FIG. 4C.

To usefully reduce image-affecting plate-out, a desired shell velocity $Vel._s$ should move a point on its surface through the development zone (distance L) in a period $t_s$ less than $t_p$, thus $$t_s = (L/Vel._s) < t_p = (d/Vel._m); \text{ or}$$

$$Vel._s > (Vel._m \cdot L)/d; \text{ or about } 3 \cdot (Vel._m \cdot L)/d.$$

Most preferably:

$$Vel._s >> (Vel._m \cdot L)/d;$$

for example, approximately equal to or greater than about:

$$10 \cdot (Vel._m \cdot L)/d.$$

We have found that with development systems in accord with the present invention, the "d" value (in inches) is such that it is useful for the shell to be rotated with a peripheral (liner) velocity $Vel._s$ greater than about 1.0 $Vel._m \cdot L$, where $Vel._m$ is in inches per second and L is in inches (i.e., a "one divided by d inches" factor being incorporated). In the metric system where "d" and "L" are in cm and $Vel._m$ ;is in cm/sec, the corresponding desirable minimum shell velocity $Vel._s$, in cm/sec, is about 0.4 $Vel._m \cdot L$. The shell velocity $Vel._s$ (in inches/sec) is most preferably at least $3 \times Vel._m \times L$ (where L is in inches and $Vel._m$ in inches/sec) or in the metric system $Vel._s$ (in cm/sec) most preferably at least about 1.2 $Vel._m \cdot L$ The above described analysis and our experiments indicate that the image defects described with respect to 4A to 4C can be avoided or significantly reduced if the shell is rotated in either direction at a rate consistent with the foregoing, and in one aspect the present invention contemplates rotating the shell of the development system in such a manner.

However, we find it to be highly preferred that the shell rotate in a direction such that its peripheral portions pass the development zone in a direction co-current with the photoconductor's moving direction. This preferred shell direction is influenced by our determination of a preferred developer flow direction and a preferred magnetic core rotation direction.

Figure 5B:
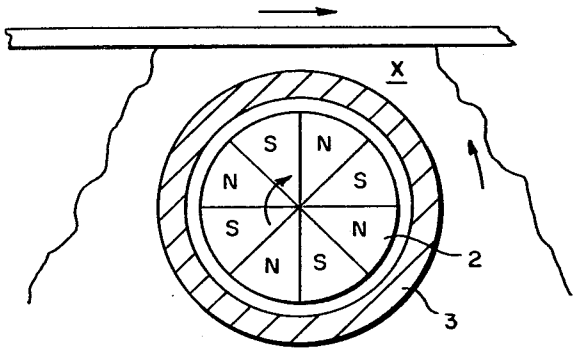
FIGS. 5A and 5B are views similar to FIG. 3, but illustrating other phenomena relating to the present invention.
Figure 5A:
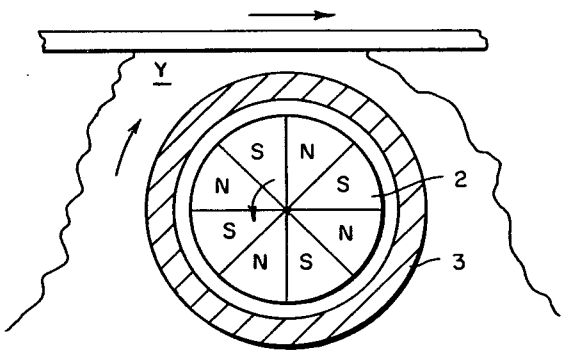

For a better understanding of one reason for the preferred co-current direction, refer to FIGS. 5A and 5B, which schematically show magnetic brushes similar to that of FIG. 3 (with a rotating core 2 and stationary shell 3). As indicated by arrows, the core 2 in FIG. 5A rotates counterclockwise causing developer to flow clockwise and through the development zone in a direction co-current with the photoconductor. The core and developer directions are the opposite in the FIG. 5B applicator, causing a counter-current (with respect to the photoconductor movement) flow of developer through the development zone. We have found that in the FIG. 5B countercurrent developer flow mode, the developer build up zone "X" is significantly larger than the analagous developer build up zone "Y" of the FIG. 5A co-current developer flow mode and that the FIG. 5B mode presents several problems.

First, the larger build up zone X of the FIG. 5B mode causes magnetic carrier in the developer mixture to move farther from the constraining magnetic fields of the magnets of core 2. This larger distance enhances the likelihood of carrier pick-up by the photoconductor. In contrast we have found that the smaller zone Y of the FIG. 5A (co-current developer flow) mode decreases likelihood of carrier escape from the core magnet fields. Moreover, in the FIG. 5A mode whatever carrier in zone Y that might be picked up by the photoconductor must move back into the fields of the magnets of core 20 prior to leaving the development zone on the photoconductor. Image-area carrier pick-up is therefore effectively scavenged by the developer applicator in the FIG. 5A mode and this is not true with respect to the FIG. 5B mode of operation. In addition to minimizing carrier pick-up we have found the FIG. 5A co-current developer flow mode to provide more reliable and tolerant smoothness of developed images. Moreover, as subsequently described in more detail, highly important advantages are obtained with co-current developer direction and proper selection of the developer velocity vis-a-vis the photoconductor velocity.

Based on the preferred co-current developer flow direction (for the reasons described above, as well as subsequently), we have found it to be preferable for the shell rotation to be in the same direction as the direction of developer flow and for the core rotation to be in the opposite direction. More specifically, we have found it to be highly desirable for developer to be supplied to the development zone at a fairly rapid rate (to enable complete image development), and to add the relative velocity components which shell and core rotation contribute to resultant developer transport rate, rather than to subtract them (as would be the case if the shell rotation direction were opposite the preferred developer flow direction).

Considering the foregoing discussion, it will be recognized that we have thus far provided as preferred system parameters that: (1) the preferred rotation direction for the developer is co-current to the photoconductor; (2) the preferred magnetic core rotation direction is counter-current to the photo-conductor; (3) the preferred shell rotation direction is co-current to the photoconductor; and (4) the preferred minimum rotation rate for the shell complies with the relation $Vel._s > 0.3$ $Vel._m \cdot L$. *Other important parameters of the development system include: (a) the maximum useful rotation rate, (b) the useful rotational rate range for the magnetic core, and (c) preferred shell and core rotation rates.*

In determining parameters (a), (b) and (c) above, we found it highly desirable to first consider the useful and preferred values for what we term the cumulative developer transport rate (CDT rate), viz. the shell-effected developer transport rate plus the magnetic-core-effected developer transport rate. We have found that such CDT rate selections are importantly dependent on the linear velocity of the image member's movement through the development zone. Thus, in accord with another significant aspect of the present invention, we have found it highly desirable that the developer pass through the developer zone co-currently with the image member and that the CDT rate (i.e. and thus the developer's linear velocity through the development zone) be generally equal to (i.e. within about ±15% of) the image member linear velocity. This matching of CDT rate and photoconductor velocity provides highly useful results for many images. However, a more preferred CDT rate, in accord with this aspect of the present invention, is one that matches the developer linear velocity to the photoconductor linear velocity within the range of about ±7% of the photoconductor linear velocity. This preferred rate is highly desirable for obtaining good development of fine-line and half-tone dot patterns in images. Slower developer rates lead to poorly developed leading image edges and faster rates to poorly developed trailing edges. Most preferably the photoconductor and developer velocities are substantially equal so as to provide excellent development of leading and trailing edges, fine-line portions and half-tone dot patterns. Thus, by means of high speed photography we have confirmed that as CDT rates more closely approximate a zero relative velocity vis-a-vis the photoconductor continuing improvement is attained in development completeness of solid area edges, fine lines and half-tone dot patterns. In embodiments where it is desired for the shell to rotate in a direction opposite (i.e. counter-current to the photoconductor direction) to the preferred net developer flow direction (i.e. co-current to the photoconductor direction), it is highly preferred that the core rotation be sufficient to make the CDT rate in accord with the foregoing.

Considering next the useful and preferred rotational rates for the magnetic core, guidelines of from about 1000–3000 RPM are described in the above noted Miskinis and Jadwin application. That teaching also describes that developer transport rate increases, for a given core rotation speed, with increases in the number of alternating magnetic poles in the rotating magnetic core. In accord with another important aspect of the present invention, we find it is highly desirable (from the viewpoint of attaining preferred minimum development contrast with developers of the types described above) to have the magnetic core and its rotating means cooperate to subject each portion of a photoconductor passing through the development zone to at least 5 pole transitions within the active development nip (i.e. distance L in FIG. 3). One skilled in the art will appreciate that given a nominal photoconductor member velocity $Vel._m$ and development zone length L, specific core constructions and core rotation rates can be selected to comply with this preferred feature in accord with the relation:

$$(P_t \cdot L)/Vel._m = Pd \geqq 5$$

where $P_t$ is the number of pole transitions per sec (number of core poles × core revolutions per sec) and Pd is the number of pole transitions to which each image member portion, moving at velocity $Vel._m$, is subjected within the active development region of the length L. This pole transition rate provides adequate tumbling of the carrier in the development zone to efficiently utilize the attracted toner. In this regard, it is highly preferred that the magnetic core regard, it is highly preferred that the magnetic core comprise a plurality of closely spaced magnets located around the periphery and that the number of magnets be sufficient to subject photoconductor portions to this desired >5 pole transitions within the development nip without extremely high core rotation rates. Cores with between 8 and 24 magnetic poles have been found highly useful.

Based on this desirable minimum pole transition rate and the shell diameter, desirable minimum magnet-effected transport rates can be calculated in terms of a linear velocity (or a similar developer transport rate measured experimentally, e.g. with high speed photography, with a stationary shell and the core rotating at the minimum pole transistion rate). The preferred magnet-effected developer transport rate also wil depend on the system parameters mentioned above with respect to the preferred CDT rate.

With the maximum cumulative developer transport rate CDT rate (max.) and the minimum magnet-effected developer transport rate MDT rate (min.) selected as described above, the maximum desirable shell-effected developer transport rate SDT rate (max.), and thus the maximum desirable shell rotation rate, can be determined by the relation:

$$\text{SDT rate (max.)} = \text{CDT rate (max.)} - \text{MDT rate (min.)}$$

Similarly, the preferred shell-effected developer transport rate and thus the preferred shell rotational rate can be determined by the relation:

$$\text{SDT rate (pref.)} = \text{CDT rate (pref.)} - \text{MDT rate (pref.)}$$

As described above the presently preferred CDT rate is one that provides approximately the same linear velocity for the developer contacting the photoconductor as the developed photoconductor's linear velocity. The preferred MDT rate is one that provides for each portion of the photoconductor image member, 5 or more pole transitions during its passage through the active development zone and will depend on the contrast characteristics desired for the development system.

With the foregoing general principles and procedures of the invention in mind, now refer back to FIGS. 1 and 2 where one preferred development system is illustrated. Thus a supply of developer D is contained within a housing 20, having mixing means 21 located in a developer sump. A non-magnetic shell portion 21, (e.g., formed of stainless steel, aluminum, conductively coated plastic or fiberglass or carbon filled plexiglass) is located in the housing 20 and mounted for rotation on a central axis by bearings 22. Drive means 23 is adapted to rotate the shell counterclockwise as shown in FIG. 1 and the shell is coupled to a source of reference potential 25. Within the shell 21 a magnetic core is mounted for rotation on bearings 22 and 27 and drive means 24 is adapted to rotate the core in a clockwise direction as viewed in FIG. 1. The core can have various forms known in the art but the illustrated embodiment comprises a ferrous core 26 having a plurality of permanent magnet strips 28 located around its periphery in alternating polarity relation (See FIG. 1). The magnetic strips of the applicator can be made up of any one or more of a variety of well-known permanent magnet materials. Representative magnetic materials include gamma ferric oxide, and "hard" ferrites as disclosed in U.S. Pat. No. 4,042,518 issued Aug. 16, 1977, to L. O. Jones. The strength of the core magnetic field can vary widely, but a strength of at least 450 gauss, as measured at the core surface with a Hall-effect probe, is preferred and a strength of from about 800 to 1600 gauss is most preferred. In some applications electromagnets might be useful. Preferred magnet materials for the core are iron or magnetic steel.

In general, the core size will be determined by the size of the magnets used, and the magnet size is selected in accordance with the desired magnetic field strength. As mentioned above, we have found a useful number of magnetic poles for a 2" core diameter to be between 8 and 24 with a preferred range between 12 and 20; however this parameter will depend on the core size and rotation rate. The more significant parameter is the pole transition rate and it is highly preferred that this be as described above. As some specific examples we have found a 2-inch diameter roller with 12 poles to be useful for developing with photoconductor velocities in the range of from about 10 to 25 inches/sec. A 2-inch diameter core with 20 poles has been useful for developing with photoconductor velocities up to 35 inches/sec. Similarly we have found that good development can be obtained at photoconductor velocity of 30 inches/sec. with a 2.75" diameter core having 16 magnets. Preferably the shell-to-photoconductor spacing is relatively close, e.g., in the range from about 0.01 inches to about 0.03 inches. A skive 30 is located to trim the developer fed to the development zone for the photoconductor 18 and desirably has about the same spacing from the shell as the photoconductor-to-shell spacing. One skilled in the art will appreciate that there are various other alternative development station configurations that can function in accord with the general principles of the present invention which have been previously outlined.

The characteristics of the dry developer compositions such as are particularly useful in accord with the present invention are described below and in more detail in U.S. application Ser. No. 440,146, which is incorporated by reference for that teaching. In general such developer comprises charged toner particles and oppositely charged carrier particles that contain a magnetic material which exhibits a predetermined, high-minimum-level of coercivity when magnetically saturated. More particularly such high-minimum-level of saturated coercivity is at least 100 gauss (when measured as described below) and the carrier particles can be binderless carriers (i.e., carrier particles that contain no binder or matrix material) or composite carriers (i.e. carrier particles that contain a plurality of magnetic material particles dispersed in a binder). Binderless and composite carrier particles containing magnetic materials complying with the 100 gauss minimum saturated coercivity levels are referred to herein as "hard" magnetic carrier particles.

In composite carrier particles utilized in accord with the present invention, the individual bits of the magnetic material should preferably be of a relatively uniform size and smaller in diameter than the overall composite carrier particle size. The average diameter of the magnetic material desirably are no more than about 20 percent of the average diameter of the carrier particle. Preferably, a much lower ratio of average diameter of magnetic component to carrier can be used. Excellent results are obtained with magnetic powders of the order of 5 microns down to 0.05 micron average diameter. Even finer powders can be used when the degree of subdivision does not produce unwanted modifications in the magnetic properties and the amount and character of the selected binder produce satisfactory strength, together with other desirable mechanical properties in the resulting carrier particle. The concentration of the magnetic material can vary widely. Proportions of finely divided magnetic material, from about 20 percent by weight to about 90 percent by weight, of the composite carrier particle can be used.

The matrix material used with the finely divided magnetic material is selected to provide the required mechanical and electrical properties. It desirably (1) adheres well to the magnetic material, (2) facilitates formation of strong, smooth-surfaced particles and (3) possesses sufficient difference in triboelectric properties from the toner particles with which it will be used to insure the proper polarity and magnitude of electrostatic charge between the toner and carrier when the two are mixed.

The matrix can be organic, or inorgainic such as a matrix composed of glass, metal, silicon, resin or the like. Preferably, an organic material is used such as a natural or synthetic polymeric resin or a mixture of such resins having appropriate mechanical and triboelectric properties. Appropriate monomers (which can be used to prepare resins for this use) include, for example, vinyl monomers such as alkyl acrylates and methacrylates, styrene and subtituted styrenes, basic monomers such as vinyl pyridines, etc. Copolymers prepared with these and other vinyl monomers such as acidic monomers, e.g., acrylic or methacrylic acid, can be used. Such copolymers can advantageously contain small amounts of polyfunctional monomers such as divinylbenzene, glycol dimethacrylate, triallyl citrate and the like. Condensation polymers such as polyesters, polyamides or polycarbonates can also be employed.

Preparation of such composite carrier particles may involve the application of heat to soften thermoplastic material or to harden termosetting material; evaporative drying to remove liquid vehicle; the use of pressure, or of heat and pressure, in molding, casting, extruding, etc., and in cutting or shearing to shape the carrier particles; grinding, e.g., in a ball mill to reduce carrier material to appropriate particle size; and shifting operations to classify the particles.

According to one preparation technique, the powdered magnetic material is dispersed in a dope or solution of the binder resin. The solvent may then be evaporated and the resulting solid means subdivided by grinding and screening to produce carrier particles of appropriate size.

According to another technique, emulsion or suspension polymerization is used to produce uniform carrier particles of excellent smoothness and useful life.

As used herein with respect to a magnetic material (such as in binderless or composite carrier particles) the term coercivity and saturated coercivity refer to the external magnetic field (measured in gauss as described below) that is necessary to reduce the material's remanance (Br) to zero while it is held stationary in the external field and after the material has been magnetically saturated (i.e., after the material has been permanently magnetized). Specifically, to measure the coercivity of the carrier particles' magnetic material, a sample of the material (immobilized in a polymer matrix) can be placed in the sample holder of a Princeton Applied Research Model 155 Vibrating Sample Magnetometer, available from Princeton Applied Research Co., Princeton, N. J., and a magnetic hysteresis loop of external field (in gauss units) versus induced magnetism (in EMU/gm) plotted.

Figure 6:
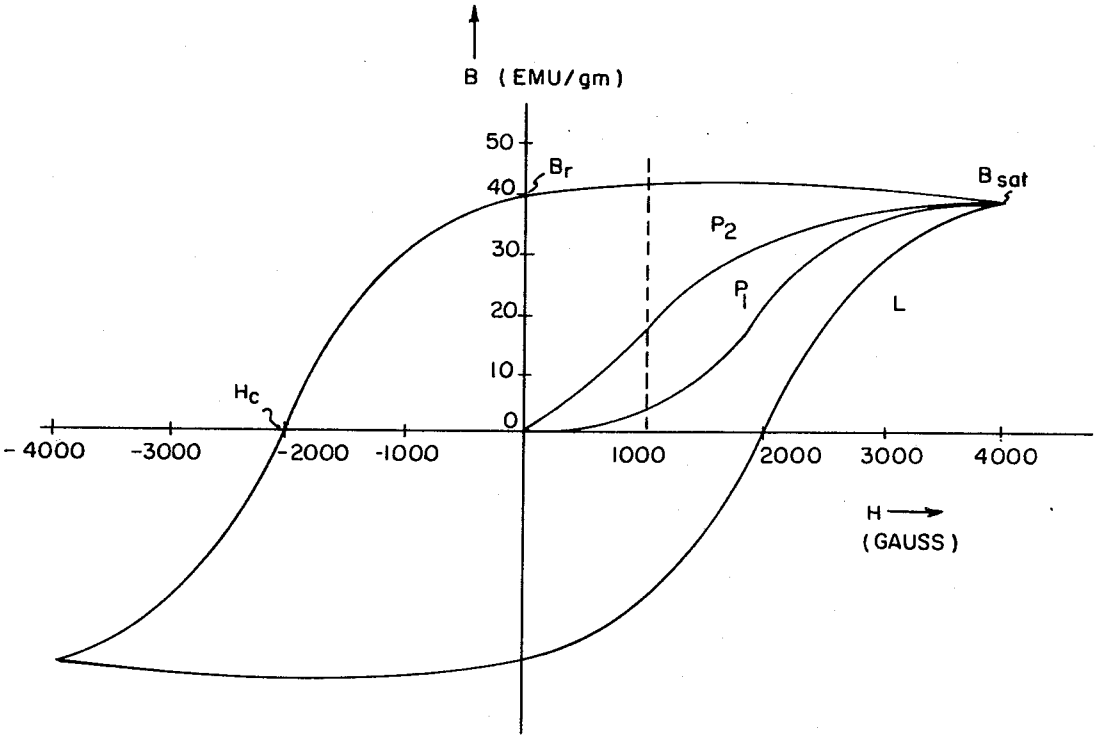
FIG. 6 is a diagram indicating magnetic characteristic of carrier useful in accord with the present invention.

FIG. 6 represents a hysteresis loop L for a typical "hard" magnetic carrier when magnetically saturated. When the carrier material is magnetically saturated and immoblized in an applied magnetic field H of progressively increasing strength, a maximum, or saturated magnetic moment, Bsat, will be induced in the material. If the applied field H is further increased, the moment induced in the material will not increase any further. When the applied field is progressively decreased through zero, reversed in applied polarity and progressively increased in the reverse polarity, the induced moment B of the carrier material will ultimately become zero and thus be on the threshold of reversal in induced polarity. The value of the applied field H (measured in gauss in an air gap such as in the above-described magnetometer apparatus) that is necessary to bring about the decrease of the remanance, Br, to zero is called the coercivity, Hc, of the material. The carriers of developers useful in the present invention, whether composite or binder-free carriers, preferably exhibit a coercivity of at least 500 gauss when magnetically saturated, most preferably a coercivity of at least 1000 gauss.

It is also important that there be sufficient magnetic attraction between the applicator and the carrier particles to hold the latter on the applicator shell during core rotation and thereby reduce carrier transfer to the image. Accordingly, the magnetic moment, B, induced in the carrier magnetic material by the field, H, of the rotating core, desirably is at least 5 EMU/gm, preferably at least 10 EMU/gm, and most preferably at least 25 EMU/gm, for applied fields of 1000 gauss or more. In this regard, carrier particles with induced fields at 1000 gauss of from 40 to 100 EMU/gm have been found to be particularly useful.

FIG. 6 shows the induced moment, B, for two different materials whose hysterisis loop is the same for purposes of illustration. These materials respond differently to magnetic fields as represented by their permeability curves, $P_1$ and $P_2$. For an applied field of 1000 gauss as shown, material $P_1$ will have a magnetic moment of about 5 EMU/gm, while material $P_2$ will have a moment of about 15 EMU/gm. To increase the moment of either material, one skilled in the art can select from at least two techniques: he can either increase the applied field of the core above 1000 gauss or subject the material off-line to a field higher than the core field and thereafter reintroduce the material into the field of the core. In such off-line treatment, the material is preferably magnetically saturated, in which case either of the materials shown in FIG. 6 will exhibit an induced moment, B, of about 40 EMU/gm.

It will be appreciated by those skilled in the art that the carrier particles in the two-component developer useful with the present invention need not be magnetized in their unused, or fresh, state. In this way, the developer can be formulated and handled off-line without unwanted particle-to-particle magnetic attraction. In such instances, aside from the necessary coercivity requirements, it is simply important that, when the developer is exposed to either the field of the rotatable core or some other source, the carrier attain sufficient induced moment, B, to cling to the shell of the applicator. In one embodiment, the permeability of the unused carrier magnetic material is sufficiently high so that, when the developer contacts the applicator, the resulting induced moment is sufficient to hold the carrier to the shell without the need for off-line treatment as noted above.

Useful "hard" magnetic materials include ferrites and gamma ferric oxide. Preferably, the carrier particles are composed of ferrites, which are compounds of magnetic oxides containing iron as a major metallic component. For example, compounds of ferric oxide, $Fe_2O_3$, formed with basic metallic oxides having the general formula $MFeO_2$ or $MFe_2O_4$ where M represents a mono- or divalent metal and the iron is in the oxidation state of +3 are ferrites.

Preferred ferrites are those containing barium and/or strontium, such as $BaFe_{12}O_{19}$, $SrFe_{12}O_{19}$ and the magnetic ferrites having the formula $MO.6Fe_2O_3$, where M is barium, strontium or lead, as disclosed in U.S. Pat. No. 3,716,630 issued Feb. 13, 1973, to B. T. Shirt, the disclosure of which is incorporated herewith by reference.

The size of the "hard" magnetic carrier particles useful in the present invention can vary widely, but desirably the average particle size is less than 100 microns. A preferred average carrier particle size is in the range from about 5 to 45 microns. From the viewpoint of minimizing carrier pick-up by the developed image, it has been found preferable to magnetically saturate such small carrier particles so that, in a core field of 1000 gauss, for example, a moment of at least 10 EMU/gm is induced, and a moment of at least 25 EMU/gm is preferably induced.

In accord with the present invention, carrier particles are employed in combination with electrically insulative toner particles to form a dry, twocomponent composition. In use the toner and developer should exhibit opposite electrostatic charge, with the toner having a polarity opposite the electrostatic image to be developed.

Desirably tribocharging of toner and "hard" magnetic carrier is achieved by selecting materials that are positioned in the triboelectric series to give the desired polarity and magnitude of charge when the toner and carrier particles intermix. If the carrier particles do not charge as desired with the toner employed, the carrier can be coated with a material which does.

The carrier/toner developer mixtures of the present invention can have various toner concentrations, and desirably high concentrations of toner can be employed. For example the developer can contain from about 70 to 99 weight percent carrier and about 30 to 1 weight percent toner based on the total weight of the developer; preferably, such concentration is from about 75 to 92 weight percent carrier and from about 25 to 8 weight percent toner.

The toner component can be a powdered resin which is optionally colored. It normally is prepared by compounding a resin with a colorant, i.e., a dye or pigment, and any other desired addenda. If a developed image of low opacity is desired, no colorant need be added. Normally, however, a colorant is included and it can, in principle, be any of the materials mentioned in *Colour Index,* Vols. I and II, 2nd Edition. Carbon black is especially useful. The amount of colorant can vary over a wide range, e.g., from 3 to 30 weight percent of the polymer.

The mixture is heated and milled to disperse the colorant and other addenda in the resin. The mass is cooled, crushed into lumps and finely ground. The resulting toner particles range in diameter from 0.5 to 25 microns with an average size of 1 to 16 microns. In this regard, it is particularly useful to formulate the developers for the present invention with toner particles and carrier particles which are relatively close in average diameter. For example, it is desirable that the average particle size ratio of carrier to toner lie within the range from about 4:1 to about 1:1. However, carrier-to-toner average particle size ratios of as high as 50:1 are also useful.

The toner resin can be selected from a wide variety of materials, including both natural and synthetic resins and modified natural resins, as disclosed, for example, in the patent to Kasper et al, U.S. Pat. No. 4,076,857 issued Feb. 28, 1978. Especially useful are the crosslinked polymers disclosed in the patent to Jadwin et al, U.S. Pat. No. 3,938,992 issued Feb. 17, 1976, and the patent to Sadamatsu et al, U.S. Pat. No. 3,941,898 issued Mar. 2,1976. The crosslinked or noncrosslinked copolymers of styrene or lower alkyl styrenes with acrylic monomers such as alkyl acrylates or methacrylates are particularly useful. Also useful are condensation polymers such as polyesters.

The shape of the toner can be irregular, as in the case of ground toners, or spherical. Spherical particles are obtained by spray-drying a solution of the toner resin in a solvent. Alternatively, spherical particles can be prepared by the polymer bead swelling technique disclosed in European Pat. No. 3905 published Sep. 5, 1979, to J. Ugelstad.

The toner can also contain minor components such as charge control agents and antiblocking agents. Especially useful charge control agents are disclosed in U.S. Pat. No. 3,893,935 and British Pat. No. 1,501,065. Quaternary ammonium salt charge agents as disclosed in *Research Disclosure,* No. 21030, Volume 210, October, 1981 (published by Industrial Opportunities Ltd., Homewell, Havant, Hampshire, PO9 1EF, United Kingdom), are also useful.

Figure 2:
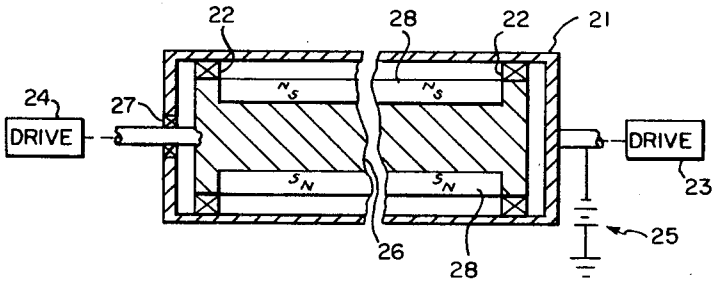
FIG. 2 is a cross-sectional view of a portion of the FIG. 1 development station.

The following example of one specific development system construction, in accord with the present invention, will be useful in further understanding of the more general preferred parameters described above. In this example the development system was incorporated in electrophotographic apparatus such as shown in FIG. 1 with the image member having a nomimal operating velocity of approximately 11.4 inches per second. The development system comprised an applicator comprising independently rotatable shell portion 21 and core portion 22, shown in FIG. 2, having separate drives 23 and 24. The shell portion was formed of stainless steel and had a 2-inch outer diameter and a thickness of 0.040 inch. The core portion comprised a notched cylinder portion 26 formed of aluminum with twelve strip magnets disposed around its periphery as shown in FIGS. 1 and 2. The spacing between the outer core surface and outer shell surface was about 0.05 inches ±0.003 inches. The magnets were formed of a hard ferrite material such as disclosed in U.S. Pat. No. 4,042,518 and exhibited a magnetic field of 1000 gauss at the shell surface. The shell to photoconductor spacing was 0.025 in. ±0.01 in. (providing a development zone length L of about 0.4″). A skive blade 30 was spaced 0.025 inches from the shell at an upstream position (relative to the developer flow direction) from the development zone. The developer comprised a mixture of hard magnetic carrier and electrically insulative toner such as previously described.

Latent electrostatic images having black unexposed charge areas of about −350 volts, "white" exposed charge areas of about −90 volts, as well as intermediate image charge areas was developed with a bias of about −100 volts applied to the applicator shell.

Magnetic core was rotated at 1500 RPM in a direction counter-current (clockwise as viewed in FIG. 1) to the photoconductor and the shell was rotated about 36 RPM in a direction co-current with photoconductor (counter-clockwise as viewed in FIG. 1). These core and shell rotation rates produced about 300 pole transitions per second and a cumulative developer flow rate of approximately 11.4 inches per second through the development zone in a direction co-current with the photoconductor. The resultant developed images exhibited excellent maximum density areas, good contrast scale, minimal carrier pick-up and freedom from leading and trailing edge defects and image defects of the kind described with respect to FIGS. 4A–4C.

The invention has been described in detail with particular reference to preferred embodiments thereof, but it will be understood that variations and modifications can be effected within the spirit and scope of the invention.

What is claimed is:

1. In electrographic apparatus of the type wherein an imaging member bearing an electrostatic pattern to be developed is moved at a predetermined linear velocity through a development zone whereat developer is applied in the presence of an electrical field that provides a developmental threshold, an improved development system comprising:

(a) a supply of dry developer mixture including electrically insulative toner marking particles and hard magnetic carrier particles;

(b) a non-magnetic, cylindrical shell which is rotatable on an axis for transporting said developer between said supply and said development zone;

(c) a magnetic core that includes a plurality of magnetic pole portions arranged around the core periphery in alternating magnetic polarity relation and is rotatable on an axis within said shell; and (d) means for rotating said core and said shell so that; (1) successive shell portions pass through said development zone at a rate which prevents toner plate-out on said shell from adversely affecting image development and (2) the linear velocity of developer movement through said development zone is co-current with and generally equal to the linear velocity of said image member.

2. The invention defined in claim 1 wherein said rotating means rotates said shell and said core at rates such that the linear velocity of developer movement through said development zone differs from the linear velocity of said image member by no more than ±7% of said image member velocity.

3. The invention defined in claim 1 wherein said rotating means rotates said shell and said core at rates such that the linear velocity of developer movement through said development zone is substantially equal to the liner velocity of said image member.

4. The invention defined in claim 1 wherein said rotating means rotates said shell so that its surface linear velocity $Vel._s$ (in inches/sec) is related to the image member linear velocity $Vel._m$ (in inches/sec) and to the length L of the development zone along the operative (in inches) by the relation:

$$Vel._s > 1.0\ Vel._m \cdot L.$$

5. The invention defined in claim 1, 2, 3 or 4 wherein said rotating means: (1) rotates said shell in a direction such that successive shell portions pass through said development zone in a direction co-current with the direction of said image member and (2) rotates said core in the opposite rotational direction from said shell.

6. The invention defined in claim 5 wherein said rotating means and said core are cooperatively constructed to subject each photoconductor portion to at least 5 pole transitions during its passage through the development zone in development operations.

7. The invention defined in claim 1, 2, 3 or 4 wherein said rotating means and said core are cooperatively constructed to subject each photoconductor portion to at least 5 pole transitions during its passage through the development zone in development operation.

8. The invention defined in claim 2 or 3 wherein said rotating means and said core are cooperatively constructed to subject each photoconductor portion to at least 5 pole transitions during its passage through the development zone and said rotating means rotates said shell so that its surface linear velocity $Vel._s$ (in inches/sec) is related to the image member linear velocity $Vel._m$ (in inches/sec) and to the length L of the development zone along the operative (in inches) by the relation:

$$Vel._s > 3\ Vel._m \cdot L.$$

9. The invention defined in claim 8 wherein said rotating means: (1) rotates said shell in a direction such that successive shell portions pass through said development zone in a direction cocurrent with the direction of said image member and (2) rotates said core in the opposite rotational direction from said shell.

10. The invention defined in claim 2 or 3 wherein said rotating means rotates said shell so that its surface linear velocity $Vel._s$ (in inches/sec) is related to the image member linear velocity $Vel._m$ (in inches/sec) and to the length L of the development zone along the operative (in inches) by the relation:

$$Vel._s > 3\ Vel._m \cdot L.$$

11. The invention defined in claim 10 wherein said rotating means: (1) rotates said shell in a direction such that successive shell portions pass through said development zone in a direction cocurrent with the direction of said image member and (2) rotates said core in the opposite rotational direction from said shell.

12. In electrographic apparatus of the type wherein an imaging member bearing an electrostatic image pattern to be developed is moved at a predetermined linear velocity through a development zone whereat developer is applied, an improved development system comprising:

(a) a supply of dry developer mixture including electrically insulative toner marking particles and hard magnetic carrier particles, both of average particle size less than about 100μ;

(b) a non-magnetic cylindrical shell that is rotatable on an axis for transporting said developer mixture between said supply and said development zone;

(c) a magnetic core that includes a plurality of magnetic pole portions arranged around the core periphery in alternating magnetic polarity relation and is rotatable on an axis within said shell; and (d) means for rotating said shell and said core, the relative operative rotational directions and rates of said core and shell being such that, in operation, developer is transported through said development zone is a direction co-current with the imaging member direction and at a linear velocity generally equal to said imaging member's linear velocity.

13. The invention defined in claim 12 wherein said rotating means rotates said shell and said core at rates such that the linear velocity of developer movement through said development zone is in the range from about 93% to about 107% of the linear velocity of said image member.

14. The invention defined in claim 12 wherein said rotating means rotates said shell and said core at rates such that the linear velocity of developer movement through said development zone is substantially equal to the linear velocity of said image member.

15. The invention defined in claim 12, 13 or 14 wherein said rotating means rotates said shell so that its surface linear velocity $Vel._s$ (in inches/sec) is related to the image member linear velocity $Vel._m$ (in inches/sec) and to the length L of the development zone along the operative (in inches) by the relation:

$$Vel._s > 3Vel._m \cdot L$$

whereby the image development affects of toner plateout on said shell is reduced.

16. The invention defined in claim 12, 13 or 14 wherein said rotating means and said core are cooperatively constructed to subject each photoconductor portion to at least 5 pole transitions during its passage through the development zone in development operations.

17. The invention defined in claim 12, 13 or 14 wherein said rotating means and said core are cooperatively constructed to provide at least 200 pole portion transitions per second and said rotating means rotates said shell so that its surface linear velocity $Vel._s$ (in inches/sec) is related to the image member linear velocity $Vel._m$ (in inches/sec) and to the length L of the development zone along the operative (in inches) by the relation:

$$Vel._s > 3Vel._m \cdot L.$$

18. The invention defined in claim 12, 13 or 14 wherein said rotating means: (1) rotates said shell in a direction co-current with said photoconductor movement and (2) rotates said core in a direction countercurrent with said photoconductor movement.

19. In electrographic apparatus of the type wherein an imaging member bearing an electrostatic image pattern to be developed is moved at a predetermined linear velocity through a development zone whereat developer is applied, an improved development system comprising:

(a) a supply of dry developer mixture including electrically insulative toner marking particles and hard magnetic carrier particles, both of average particle size less than about 100μ;

(b) a non-magnetic cylindrical shell, which has an electrically conductive surface that is coupled to a source of electrical potential to provide a development threshold and is rotatable on an axis for transporting said developer mixture between said supply and said development zone;

(c) a magnetic core that includes a plurality of magnetic pole portions arranged around the core periphery in alternating magnetic polarity relation and is rotatable on an axis within said shell; and (d) rotating means: (1) for rotating said shell so that successive shell portions pass through said development zone and at a velocity which prevents toner pate-out on said shell from adversely affecting image development and (2) for rotating said core in a rotational direction and rate such that developer is transported through said development zone in a direction co-current with the imaging member direction.

20. The invention defined in claim 19 wherein said rotating means rotates said shell so that its surface linear velocity $Vel._s$ (in inches/sec) is related to the image member linear velocity $Vel._m$ (in inches/sec) and to the length L of the development zone along the operative (in inches) by the relation:

$$Vel._s > 3Vel._m \cdot L.$$

21. The invention defined in claim 19 or 20 wherein said rotating means and said core are cooperatively constructed to subject each photoconductor portion to at least 5 pole transitions during its passage through the development zone in development operations.

22. The invention defined in claim 19 or 20 wherein said rotating means: (1) rotates said shell in a direction co-current with said photoconductor movement and (2) rotates said core in a direction countercurrent with said photoconductor movement.

23. The invention defined in claim 19 or 20 wherein said rotating means rotates said shell and said core at rates such that the linear velocity of developer movement through said development zone is substantially equal to the linear velocity of said image member.

24. In electrographic apparatus of the type including means for moving an image member bearing an electrostatic charge pattern through a development zone at a predetermined linear velocity and magnetic brush development means for supplying at said development zone a developer that comprises hard magnetic carrier particles and electrically insulating toner particles, the improvement wherein said development means comprises:

(a) means for applying across said development zone, an electrical field which urges toner particles away from portions of such charge pattern below a predetermined background charge threshold;

(b) a non-magnetic cylindrical shell which is rotatable on an axis for transporting developer between the supply and development zone;

(c) a magnetic core including a plurality of magnetic pole portions arranged around the core periphery in alternating magnetic polarity relation, said core being rotatable on an axis within said shell; and (d) means for rotating said core and said shell so that: (1) successive shell portions pass through said development zone at a rate which prevents toner plate-out on said shell from adversely affecting image development and (2) the linear velocity of developer movement through said development zone is co-current with and generally equal to the linear velocity of said image member.

25. The invention defined in claim 24 wherein said rotating means rotates said shell and said core at rates such that the linear velocity of developer movement through said development zone differs from the linear velocity of said image member by no more than ±7% of said image member velocity.

26. The invention defined in claim 24 wherein said rotating means rotates said shell and said core at rates such that the linear velocity of developer movement through said development zone is substantially equal to the linear velocity of said image member.

27. The invention defined in claim 24 wherein said rotating means rotates said shell so that its surface linear velocity $Vel._s$ (in inches/sec) is related to the image member linear velocity $Vel._m$ (in inches/sec) and to the length L of the development zone along the operative (in inches) by the relation:

$$Vel._s > 3Vel._m \cdot L.$$

28. The invention defined in claim 24, 25, 26 or 27 wherein said rotating means: (1) rotates said shell in a direction such that successive shell portions pass through said development zone in a direction co-current with the direction of said image member and (2) rotates said core in the opposite rotational direction from said shell.

29. The invention defined in claim 27 wherein said rotating means and said core are cooperatively constructed to subject each photoconductor portion to at least 5 pole transitions during its passage through the development zone in development operations.

30. The invention defined in claim 24, 25, 26 or 27 wherein said rotating means and said core are cooperatively constructed to subject each photoconductor portion to at least 5 pole transitions during its passage through the development zone in development operation.

31. The invention defined in claim 25 or 26 wherein said rotating means and said core are cooperatively constructed to subject each photoconductor portion to at least 5 pole transitions during passage through the development zone and said rotating means rotates said shell so that its surface linear velocity $Vel._s$ (in inches/sec) is related to the image member linear velocity $Vel._m$ (in inches/sec) and to the length L of the development zone along the operative (in inches) by the relation:

$$Vel._s > 3Vel._m \cdot L.$$

32. The invention defined in claim 31 wherein said rotating means: (1) rotates said shell in a direction such that successive shell portions pass through said development zone in a direction co-current with the direction of said image member and (2) rotates said core in the opposite rotational direction from said shell.

33. The invention defined in claim 25 or 26 wherein said rotating means rotates said shell so that its surface linear velocity $Vel._s$ (in inches/sec) is related to the image member linear velocity $Vel._m$ (in inches/sec) and to the length L of the development zone along the operative (in inches) by the relation:

$$Vel._s > 3Vel._m \cdot L.$$

34. The invention defined in claim 33 wherein said rotating means: (1) rotates said shell in a direction such that successive shell portions pass through said development zone in a direction co-current with the direction of said image member and (2) rotates said core in the opposite rotational direction from said shell.

35. In electrographic apparatus of the type including means for moving an image member bearing an electrostatic charge pattern through a development zone at a predetermined linear velocity and magnetic brush development means for supplying at said development zone a small particle developer that comprises hard magnetic carrier particles and electrically insulating toner particles, the improvement wherein said development means comprises:

(a) means for applying across said development zone, an electrical field which urges toner particles away from portions of such charge pattern below a predetermined background charge threshold;

(b) a non-magnetic cylindrical shell which is rotatable on an axis for transporting developer between the supply and development zone;

(c) a magnetic core including a plurality of magnetic pole portions arranged around the core periphery in alternating magnetic polarity relation, said core being rotatable on an axis within said shell; and (d) means for rotating said shell and said core, the relative operative rotational directions and rates of said core and shell being such that, in operation, developer is transported through said development zone in a direction co-current with the imaging member direction and at a linear velocity generally equal to said imaging member's linear velocity.

36. The invention defined in claim 35 wherein said rotating means rotates said shell and said core at rates such that the linear velocity of developer movement thorugh said development zone is in the range from about 93% to about 107% of the linear velocity of said image member.

37. The invention defined in claim 35 wherein said rotating means rotates said shell and said core at rates such that the linear velocity of developer movement through said development zone is substantially equal to the linear velocity of said image member.

38. The invention defined in claim 35, 36 or 37 wherein said rotating means rotates said shell so that its surface linear velocity $Vel._s$ (in inches/sec) is related to the image member linear velocity $Vel._m$ (in inches/sec) and to the length L of the development zone along the operative (in inches) by the relation:

$$Vel._s > 3Vel._m \cdot L$$

whereby the image development affects of toner plate-out on said shell is reduced.

39. The invention defined in claim 35, 36 or 37 wherein said rotating means and said core are cooperatively constructed to subject each photoconductor portion to at least 5 pole transitions during its passage through the development zone in development operations.

40. The invention defined in claim 35, 36 or 37 wherein said rotating means and said core are cooperatively constructed to subject each photoconductor portion to at least 5 pole transitions during passage through the development zone and said rotating means rotates said shell so that its surface linear velocity $Vel._s$ (in inches/sec) is related to the image member linear velocity $Vel._m$ (in inches/sec) and to the length L of the development zone along the operative (in inches) by the relation:

$$Vel._s > 3\ Vel._m \cdot L.$$

41. The invention defined in claim 35, 36 or 37 wherein said rotating means: (1) rotates said shell in a direction co-current with said photoconductor movement and (2) rotates said core in a direction countercurrent with said photoconductor movement.

42. In electrograhic apparatus of the type including means for moving an image member bearing an electrostatic charge pattern through a development zone at a predetermined linear velocity and magnetic brush development means for supplying at said development zone a developer that comprises hard magnetic carrier particles and electrically insulating toner particles, the improvement wherein said development means comprises:

(a) a non-magnetic cylindrical shell which has an electrically conductive surface that is coupled to a source of electrical potential to provide a development threshold and is rotatable on an axis for transporting developer between the supply and development zone;

(b) a magnetic core including a plurality of magnetic pole portions arranged around the core periphery in alternating magnetic polarity relation, said core being rotatable on an axis within said shell; and (c) rotating means: (1) for rotating said shell so that successive shell portions pass through said development zone and at a velocity which prevents toner plate-out on said shell from adversely affecting image development and (2) for rotating said core in a rotational direction and rate such that developer is transported through said development zone in a direction co-current with the imaging member direction.

43. The invention defined in claim 42 wherein said rotating means rotates said shell so that its surface linear velocity $Vel._s$ (in inches/sec) is related to the image member linear velocity $Vel._m$ (in inches/sec) and to the length L of the development zone along the operative (in inches) by the relation:

$$Vel._s > 3Vel._m \cdot L.$$

44. The invention defined in claim 42 or 43 wherein said rotating means and said core are cooperatively constructed to subject each photoconductor portion to at least 5 pole transitions during its passage through the development zone in development operations.

45. The invention defined in claim 42 or 43 wherein said rotating means: (1) rotates said shell in a direction co-current with said photoconductor movement and (2) rotates said core in a direction countercurrent with said photoconductor movement.

46. The invention defined in claim 42 or 43 wherein said rotating means rotates said shell and said core at rates such that the linear velocity of developer movement through said development zone is substantially equal to the linear velocity of said image member.

47. A method of developing an electrographic image member bearing an electrostatic image pattern, said method comprising:

(a) moving said image member through a development zone at a predetermined linear velocity; and (b) transporting electrographic developer, including hard magnetic carrier particles and electrically insulative toner particles, through said development zone in developing relation with the charge pattern of such moving imaging member, by:

(1) rotating a non-magnetic shell around a path, between a supply of such developer and said development zone; and (2) rotating an alternating-pole magnetic core within said shell and;

(3) controlling the directions and rotational rates of said shell and core so that: (i) developer flows through said development zone in a direction co-current with the direction of image member movement and at a linear velocity that is generally equal to the linear velocity of said image member and (ii) successive shell portions pass through said development zone at a rate which prevents toner plate-out on said shell from adversely affecting image development.

48. A method of developing an electrographic image member bearing an electrostatic pattern including image portions of charge levels in a higher range and background portions of charge levels in a lower range, said method comprising:

(a) moving said image member through a development zone at a predetermined linear velocity;

(b) applying at said development zone an electrical field that deters development of said background portions; and (c) rotating a non-magnetic shell around a path between a developer supply, comprising hard magnetic carrier particles and electrically insulative toner particles, and said development zone in a direction such that shell portions move through said development zone at a rate which prevents toner plate-out from adversely affecting image development; and (d) rotating an alternating-pole magnetic core within said shell in a direction and at a rate such that developer is transported through said development zone in a direction co-current the direction of the imaging member.

49. A method of developing an electrographic image member, which bears an electrostatic image pattern and is moving through a development zone, with developer comprising hard magnetic carrier particles and electrically insulative toner particles, using a magnetic brush applicator including an electrically biased non-magnetic shell and an alternating-pole magnetic core within the shell, said method comprising:

(a) rotating said shell so that successive portions thereof pass through said development zone in a direction co-current with adjacent image member portions and at a rate which avoids development effects by toner plated on the shell; and (b) rotating said core in a direction opposite to said shell at a rate such that the developer velocity through said development zone is at least equal to said image member velocity.

50. A method of developing an electrographic image member bearing an electrostatic image pattern, said method comprising:

(a) moving said image member through a development zone at a predetermined linear velocity; and (b) transporting electrograhic developer, including hard magnetic carrier particles and electrically insulative toner particles, through said development zone in developing relation with the charge pattern of such moving imaging member, by:

(1) rotating a non-magnetic shell around a path, between a supply of such developer and said development zone; and (2) rotating an alternating-pole magnetic core within said shell and;

(3) controlling the directions and speeds of said shell and core rotations so that developer flows through said development zone in a direction co-current with the direction of image member movement and at a linear velocity that is generally equal to the linear velocity of said image member.

51. The invention defined in claim 47, 48, 49 or 50 wherein said shell and core are rotated so that developer flows through said development zone at a linear velocity substantially equal to the linear velocity of said image member.

52. The invention defined in claim 47, 48, 49 or 50 wherein the shell and core are rotated so that developer flows through the development zone co-currently with said imaging member with a linear velocity which differs from said imaging member by no more than ±7% of the imaging member velocity.

53. The invention defined in claim 52 wherein the speed of rotation of said shell is sufficient so that its peripheral surface velocity $Vel._s$ (in inches/second) complies with the relation:

$$Vel._s > 3Vel._m \cdot L$$

where $Vel._m$ is the linear velocity of said imaging member (in inches/second) and L is the dimension (in inches) along the image member and shell paths of said development zone.

54. The invention defined in claim 47, 48, 49 or 50 wherein the speed of rotation of said shell is sufficient so that its peripheral surface velocity $Vel._s$ (in inches/-second) complies with the relation:

$$Vel._s > 3Vel._m \cdot L$$

where $Vel._m$ is the linear velocity of said imaging member (in inches/second) and L is the dimension (in inches) along the image member and shell paths of said development zone.

55. The invention defined in claim 47, 48, 49 or 50 wherein the rotation rate of said core is sufficient to subject each photoconductor portion to at least 5 pole transitions during its passage through the development zone.

* * * * *